US008246419B2

(12) United States Patent
Wu et al.

(10) Patent No.: US 8,246,419 B2
(45) Date of Patent: Aug. 21, 2012

(54) ROLLING MACHINE

(75) Inventors: Chia-Ying Wu, Taipei Hsien (TW); Ching-Chou Chang, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 946 days.

(21) Appl. No.: 12/272,915

(22) Filed: Nov. 18, 2008

(65) Prior Publication Data

US 2009/0264055 A1 Oct. 22, 2009

(30) Foreign Application Priority Data

Apr. 22, 2008 (CN) ..... 2008 1 0301250

(51) Int. Cl.
*B24B 49/00* (2006.01)

(52) U.S. Cl. ..... 451/11; 451/325; 451/552; 451/390; 451/461

(58) Field of Classification Search ..... 451/325, 451/552, 384, 390, 391, 555, 461, 438, 439; 269/47–52, 88, 99, 100, 101, 902
See application file for complete search history.

(56) References Cited

U.S. PATENT DOCUMENTS

| | | | | | |
|---|---|---|---|---|---|
| 893,875 | A * | 7/1908 | Schneider | 269/88 |
| 1,184,496 | A * | 5/1916 | Stenvall | 451/384 |
| 2,166,037 | A * | 7/1939 | Campos | 451/240 |
| 3,625,503 | A * | 12/1971 | Hall | 269/234 |
| 4,363,475 | A * | 12/1982 | McCarty | 269/69 |
| 4,445,678 | A * | 5/1984 | George | 269/88 |
| 4,583,432 | A * | 4/1986 | Bricker | 82/1.11 |
| 4,667,548 | A * | 5/1987 | Astle et al. | 82/113 |
| 4,790,695 | A * | 12/1988 | Abernethy | 408/115 R |
| 5,305,557 | A * | 4/1994 | Warncke | 451/369 |
| 5,377,456 | A * | 1/1995 | Dixon | 451/364 |
| 5,989,260 | A * | 11/1999 | Yao | 606/102 |
| 6,179,279 | B1 * | 1/2001 | Asai et al. | 269/164 |
| 6,347,458 | B1 * | 2/2002 | Kaczynski | 33/503 |
| 6,361,035 | B1 * | 3/2002 | Collins | 269/45 |
| 6,554,265 | B2 * | 4/2003 | Andronica | 269/268 |
| 7,004,682 | B1 * | 2/2006 | Moody | 405/184.4 |
| 7,144,306 | B1 * | 12/2006 | Yen | 451/57 |
| 7,252,578 | B2 * | 8/2007 | Yen | 451/178 |
| 7,252,579 | B2 * | 8/2007 | Yen | 451/231 |
| 7,309,278 | B2 * | 12/2007 | Shibata | 451/384 |
| 7,314,215 | B2 * | 1/2008 | Vosoughkia | 269/296 |
| 7,326,104 | B2 * | 2/2008 | Tung et al. | 451/57 |
| 7,338,349 | B2 * | 3/2008 | Yen | 451/28 |
| 7,371,157 | B2 * | 5/2008 | Yen | 451/57 |
| 7,381,119 | B2 * | 6/2008 | Chang | 451/388 |
| 7,820,942 | B1 * | 10/2010 | Lamsfuss | 219/121.82 |
| 2002/0084565 | A1 * | 7/2002 | Dautartas et al. | 269/289 R |

* cited by examiner

*Primary Examiner* — George Nguyen
(74) *Attorney, Agent, or Firm* — Altis Law Group, Inc.

(57) ABSTRACT

A rolling machine includes a first clipping component, a second clipping component, a lifting component, and a holding assembly. The first clipping component has a first surface and a second surface opposite to the first surface. The second clipping component has a third surface configured to contact the first surface and a fourth surface opposite to the third surface. The lifting component is connected to the first clipping component and configured to drive the first clipping component to move back and forth. The holding assembly has a first and second holders configured to be symmetrically positioned on both sides of the first clipping component.

20 Claims, 8 Drawing Sheets

ROLLING MACHINE

BACKGROUND

1. Technical Field

The present disclosure relates to auxiliary machines for grinding workpieces and, particularly, to a rolling machine.

2. Description of Related Art

Rolling machines are widely used to grind workpieces, for example, optical components. A typical rolling machine includes a pair of hollow holders. In use, a workpiece is manually aligned with the pair of hollow holders. The pair of hollow holders is then vacuumized to hold two ends of a workpiece. Each hollow holder is driven to rotate the workpiece. The workpiece is grinded into a circular shape by a grinding wheel. However, the workpiece is not accurately aligned with the pair of hollow holders via the typical rolling machine.

Therefore, a new rolling machine is desired to overcome the above-described shortcoming.

BRIEF DESCRIPTION OF THE DRAWINGS

Many aspects of the embodiment can be better understood with reference to the following drawings. The components in the drawings are not necessarily drawn to scale, the emphasis instead being placed upon clearly illustrating the principles of the embodiment. Moreover, in the drawings, like reference numerals designate corresponding parts throughout the several views.

DETAILED DESCRIPTION OF THE EMBODIMENT

Figure 1:
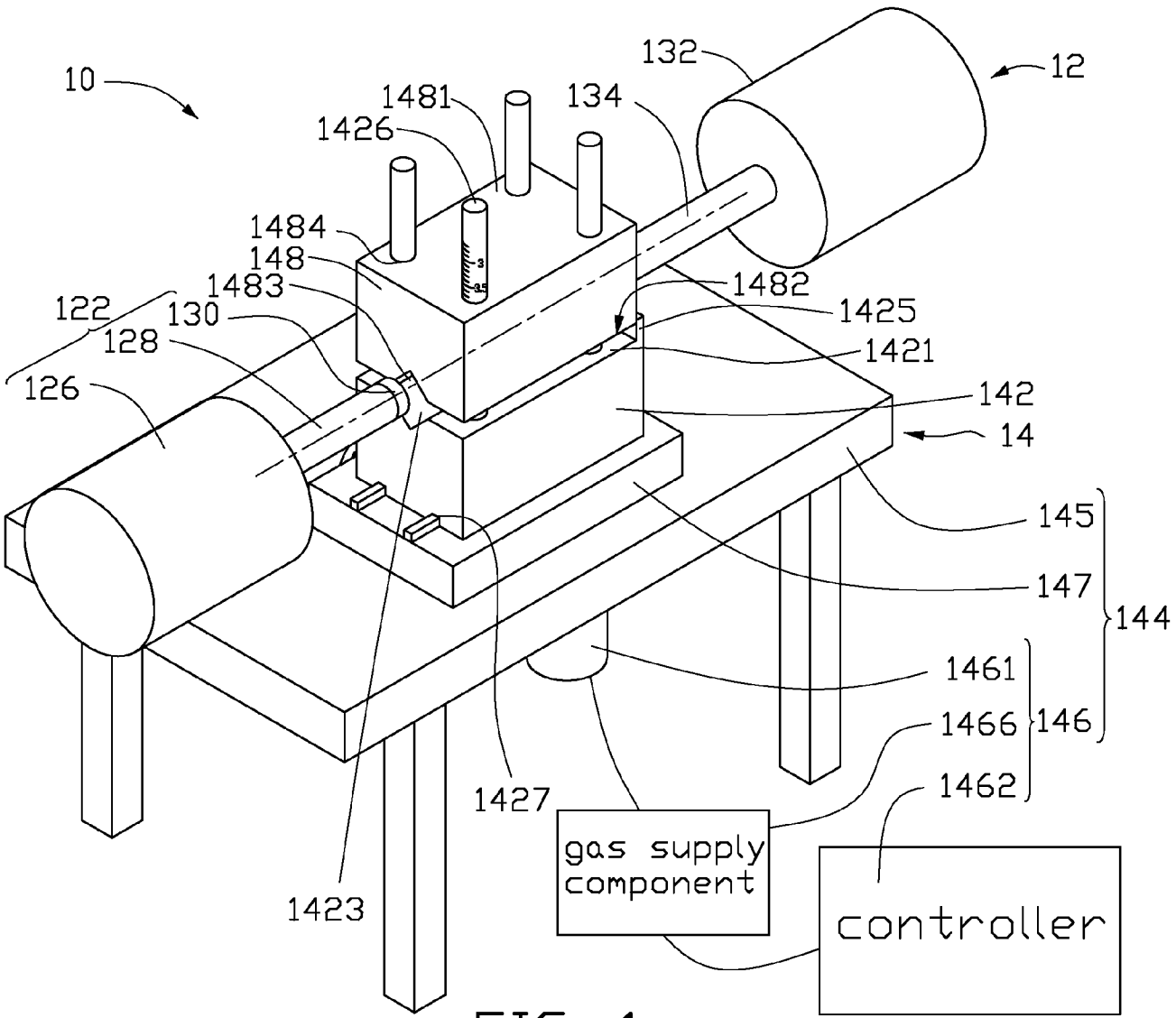
FIG. 1 is a perspective view of one embodiment of a rolling machine.
Figure 2:
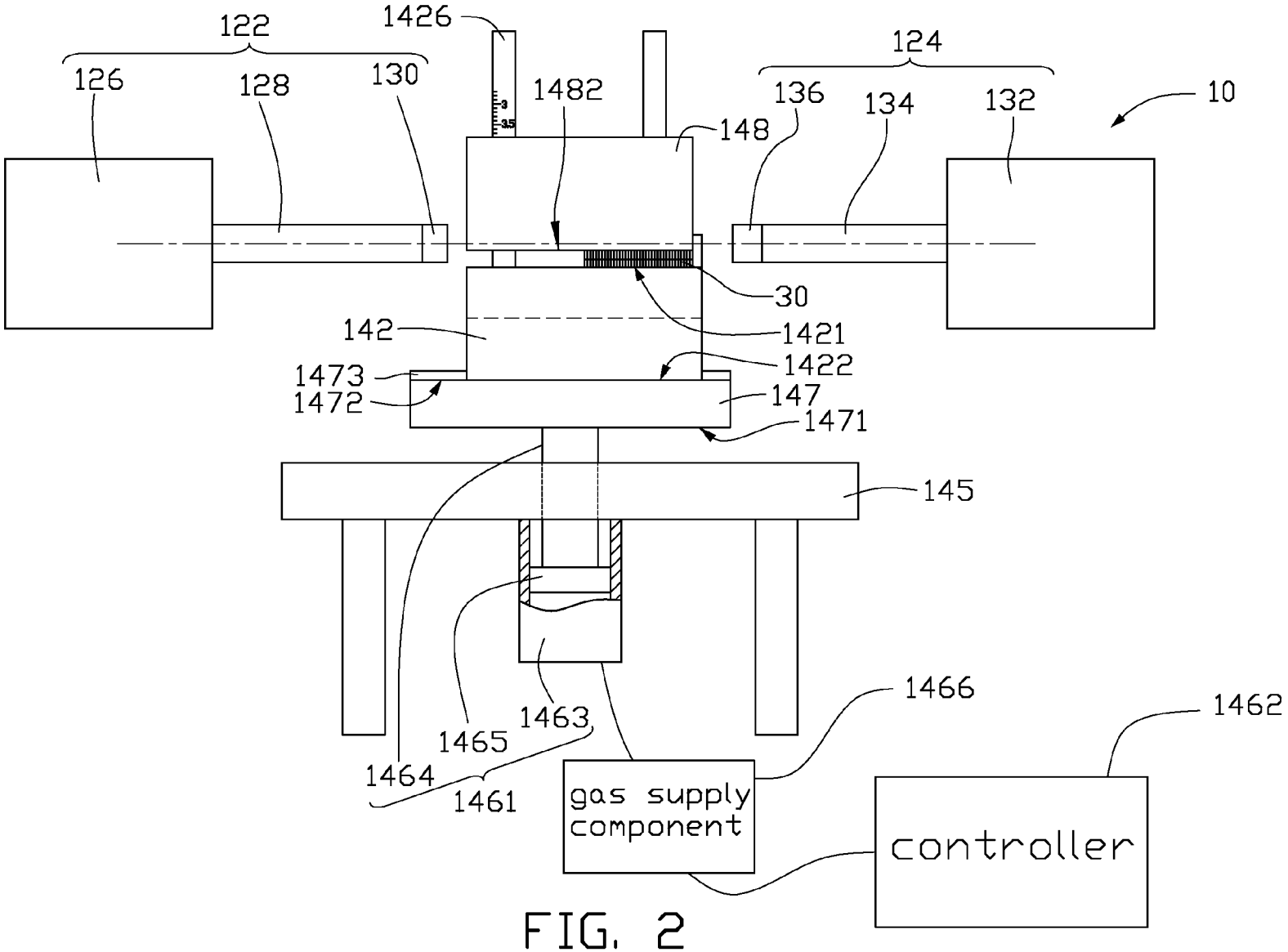
FIG. 2 is a front elevational view of the rolling machine of FIG. 1, with a plurality of workpieces positioned on the rolling machine.

Referring to FIGS. 1 and 2, one embodiment of a rolling machine 10 includes a holding assembly 12 and an auxiliary positioning assembly 14.

The holding assembly 12 is configured to hold a plurality of workpieces 30, and includes a first holder 122 and a second holder 124.

The first holder 122 includes a first driver 126, a first rotating rod 128, and a first contacting component 130. The first driver 126 is connected to an end of the first rotating rod 128 and configured to drive the first rotating rod 128 to rotate. The first contacting component 130 is connected to another end of the first rotating rod 128.

The second holder 124 is similar to the first holder 122, and includes a second driver 132, a second rotating rod 134, and a second contacting component 136. The second driver 132 is connected to an end of the second rotating rod 134 and configured to drive the second rotating rod 134 to rotate. The second contacting component 136 is connected to another end of the rotating rod 134. The first and second contacting components 130, 136 may be made of elastic materials, for example, rubber or epoxy resin.

The auxiliary positioning assembly 14 includes a first clipping component 142, a second clipping component 148, and a lifting component 144 connected to the first clipping component 142 and configured to drive the first clipping component 142 to move in a substantially perpendicular direction. The first and second clipping components 142, 148 constitute a clipping assembly.

Figure 3:
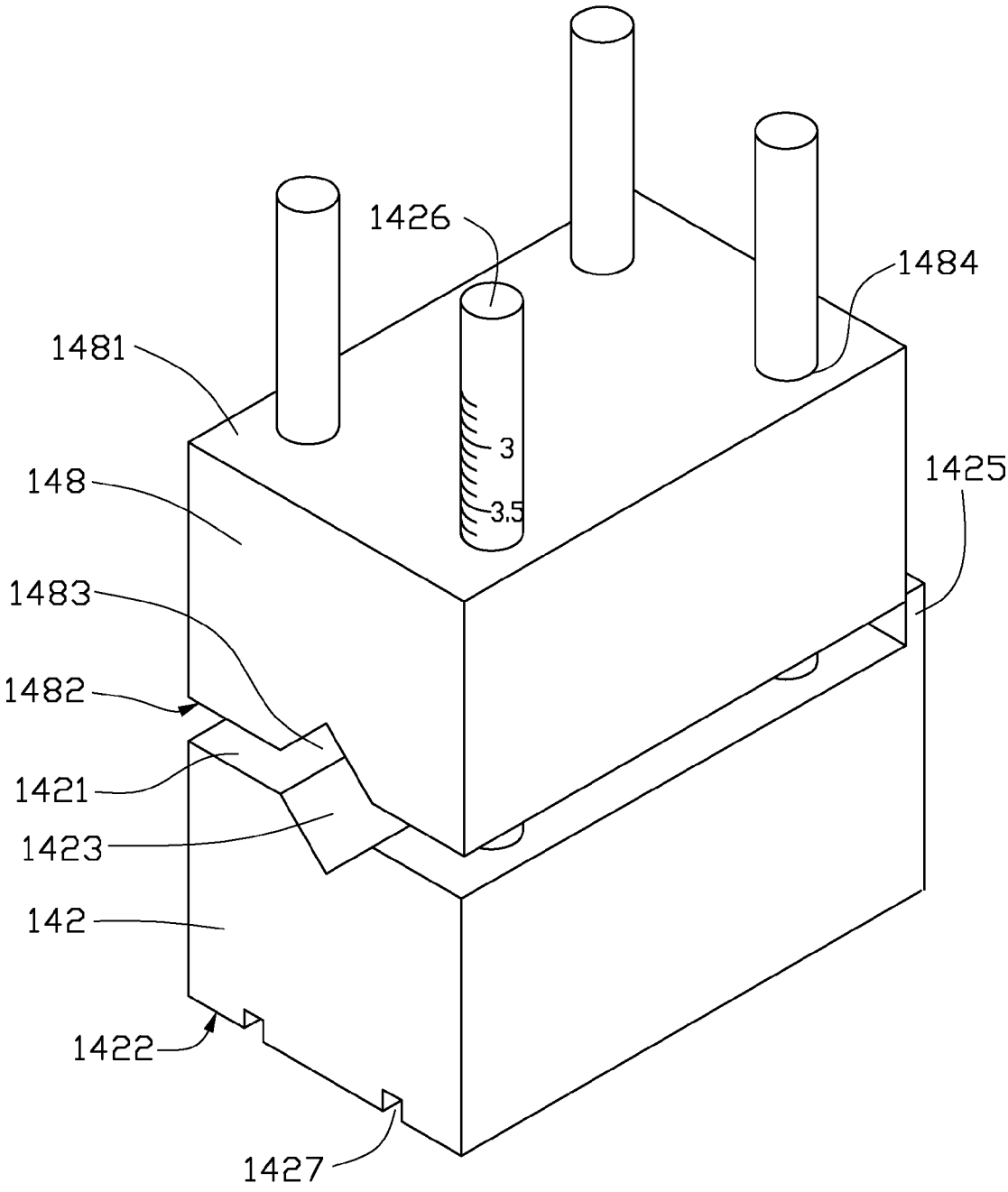
FIGS. 3 and 4 are perspective views of a first clipping component and a second clipping component of the rolling machine of FIG. 1.
Figure 4:
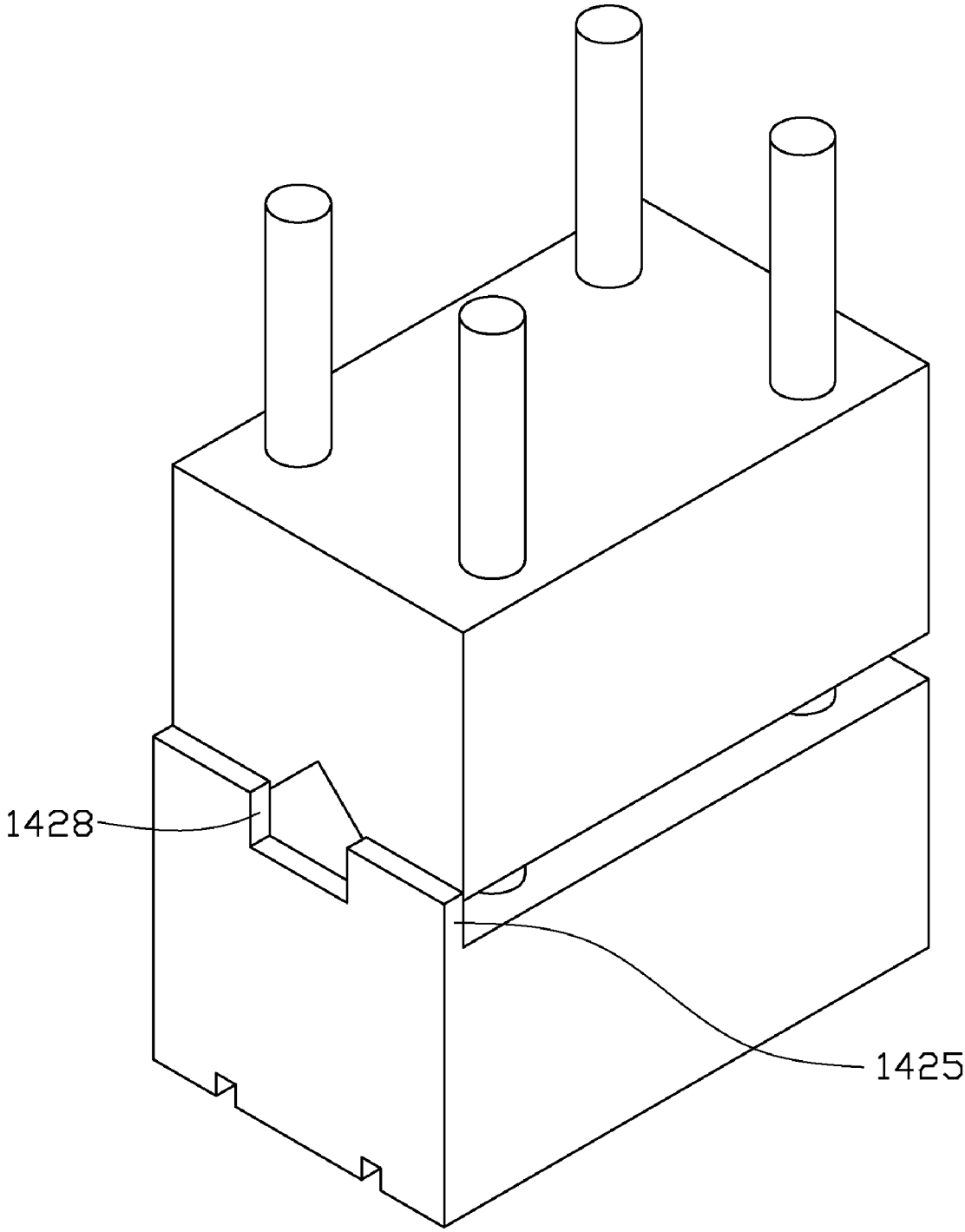

Also referring to FIGS. 3 and 4, the first clipping component 142 has a first surface 1421 and a second surface 1422 opposite to the first surface 1421. A first recess 1423 is defined in the first surface 1421 and configured to accommodate the workpieces 30. In one embodiment, the first recess 1423 may be V-shaped. The cross-section of the first V-shaped recess 1423 is formed at a right angle. Accordingly, an acute angle between each sidewall of the first V-shaped recess 1423 and the first surface 1421 is about 45 degrees.

A stopping board 1425 is positioned at an end of the first recess 1423 and configured to prevent the workpieces 30 from sliding off the first recess 1423. An opening 1428 is defined in the stopping board 1425 and configured to allow the second rotating rods 134 to pass through.

A plurality of measure rods 1426 is perpendicularly positioned on the first surface 1421. In one embodiment, at least one of the measure rods 1426 may have scales printed thereon. A plurality of first positioning units 1427 is defined in the second surface 1422.

The second clipping component 148 includes a third surface 1482 and a fourth surface 1481 opposite to the third surface 1482. A plurality of through holes 1484 is defined in the second clipping component 148 and configured to receive the measure rods 1426. A second recess 1483 is defined in the third surface 1482 and configured to accommodate the plurality of workpieces 30. In one embodiment, the second recess 1483 may be similar to the first recess 1423.

The lifting component 144 includes a first supporting unit 145, a driving unit 146, and a second supporting unit 147.

The driving unit 146 includes a driving member 1461, a controller 1462, and a gas supply component 1466. The driving member 1461 includes a cylinder 1463, a piston 1465 positioned in the cylinder 1463, and a piston rod 1464. The cylinder 1463 is secured on the first supporting unit 145. The piston rod 1464 passes through the first supporting unit 145 and is connected between the piston 1465 and the second supporting unit 147.

The gas supply component 1466 is connected to the cylinder 1463 and configured to supply gas to drive the piston 1465 to move back and forth in the cylinder 1463. The controller 1462 is coupled to the gas supply component 1466, and configured to control the amount of gas supplied to the driving member 1461 to drive the second supporting unit 147 to move with respect to the first supporting unit 145.

The second supporting unit 147 has a fifth surface 1471 configured to contact the first supporting unit 145 and a sixth surface 1472 opposite to the fifth surface 1471. A plurality of second positioning units 1473 is positioned on the sixth surface 1472. In one embodiment, the second positioning units 1473 may be strip-shaped bars, and the first positioning units 1427 may be strip-shaped recesses configured to receive the strip-shaped bars 1473. In another embodiment, the second positioning units 1473 may be strip-shaped recesses, and the first positioning units 1427 may be strip-shaped bars configured to be received in the strip-shaped recesses 1473.

In assembly, the first clipping component 142 is positioned on the second supporting unit 147. The second surface 1422 contacts the sixth surface 1472. The first positioning units 1427 engage with the second positioning units 1473. The measure rods 1426 pass through the corresponding through holes 1484. The third surface 1482 contacts the first surface 1421. The first recess 1423 is opposite to the second recess 1483. The first and second holders 122, 124 are symmetrically positioned on both sides of the first clipping component 142. Central axes of the first and second rotating rods 128, 134 are substantially collinear. The first and second contacting components 130, 136 are arranged opposite to each other.

Figure 5:
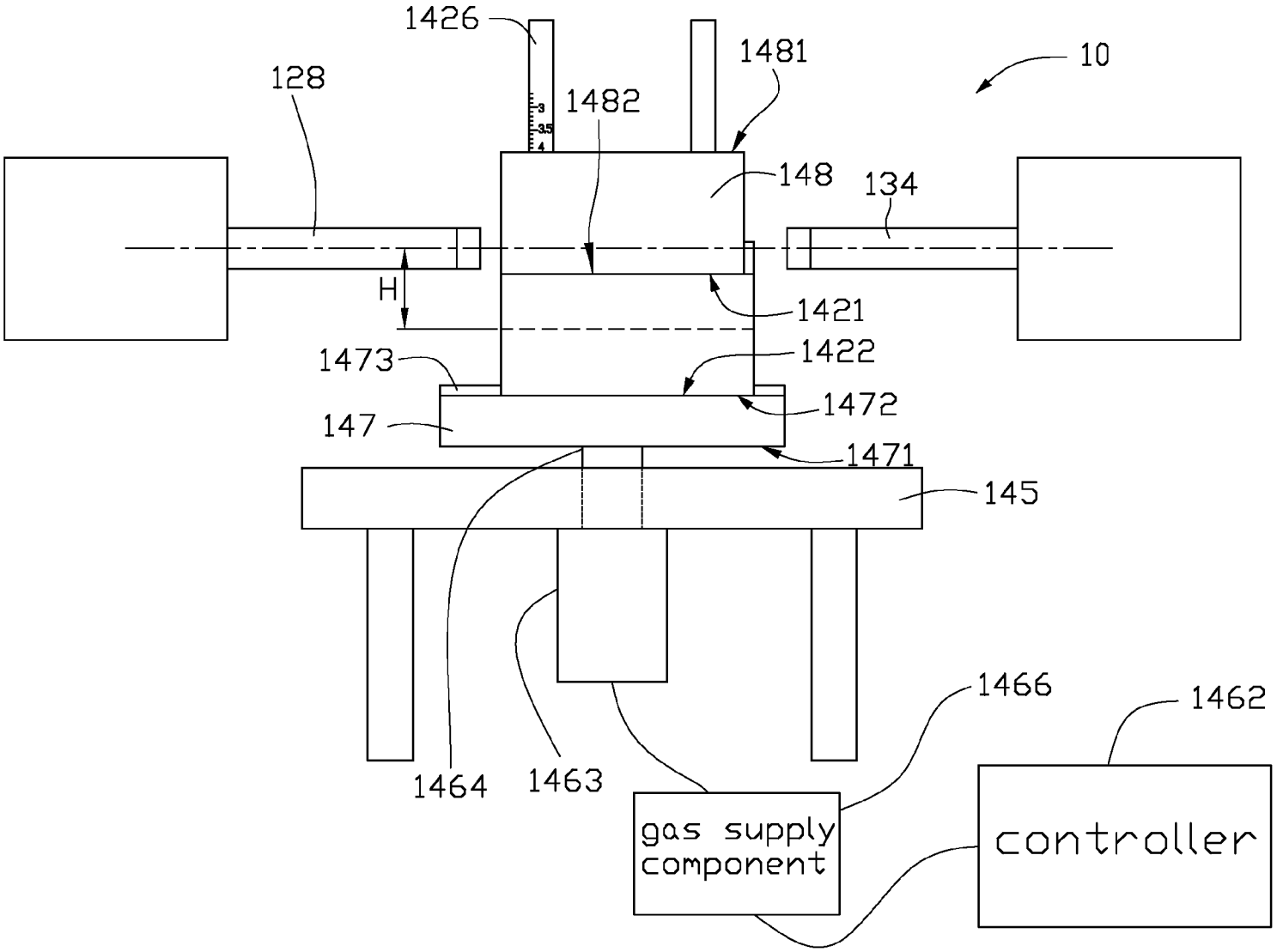
FIG. 5 is a perspective view of the rolling machine of FIG. 1, not in use.

Referring to FIG. 5, in no use, the first clipping component 142, the second clipping component 148, and the lifting component 144 are positioned on an initial position. The first recess 1483 is positioned below the first and second holders 122, 124.

Figure 6:
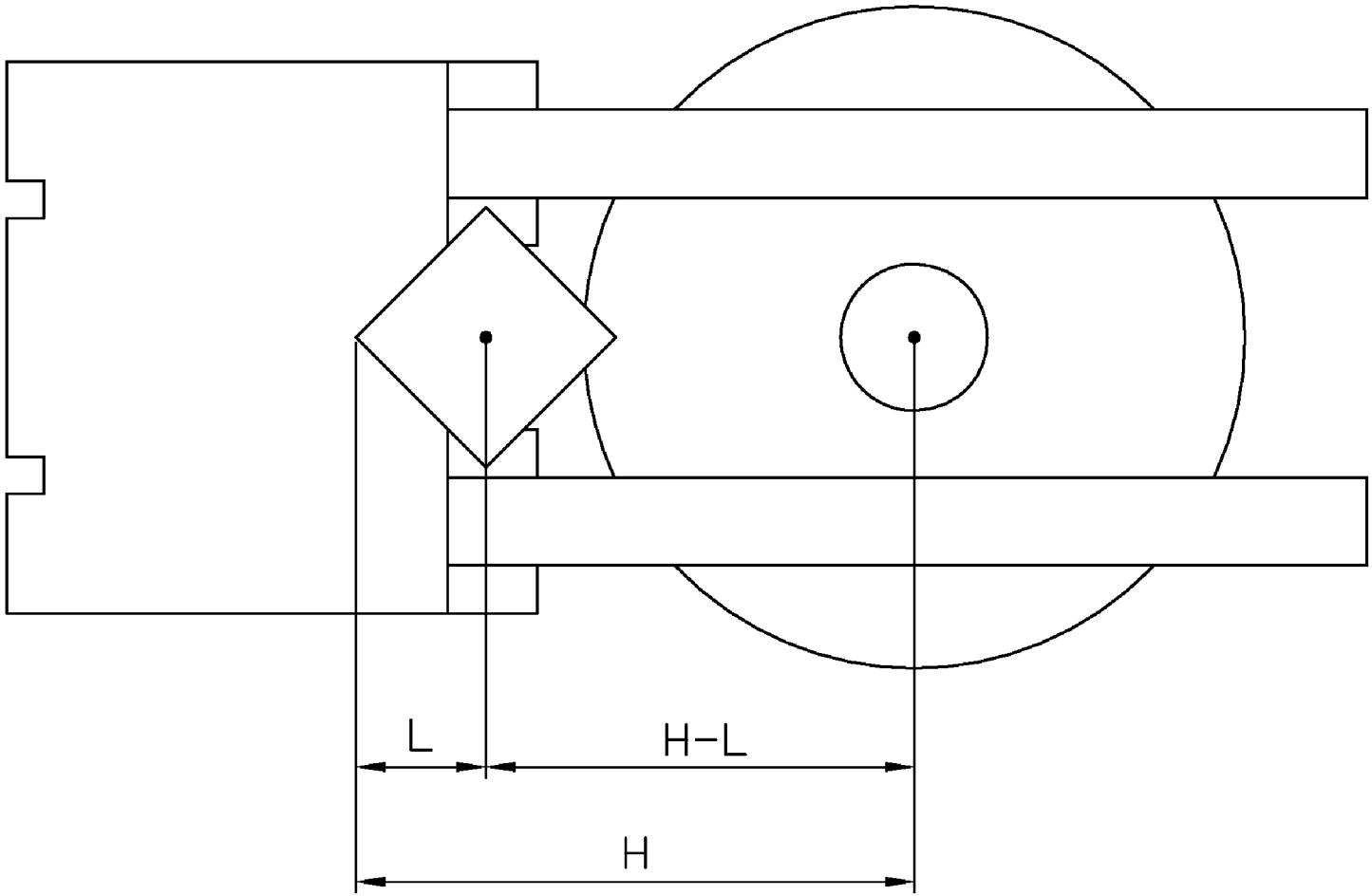
FIG. 6 is a perspective view of a holder and a first clipping component of the rolling machine of FIG. 1, with a plurality of workpieces positioned on the first clipping component.
Figure 7:
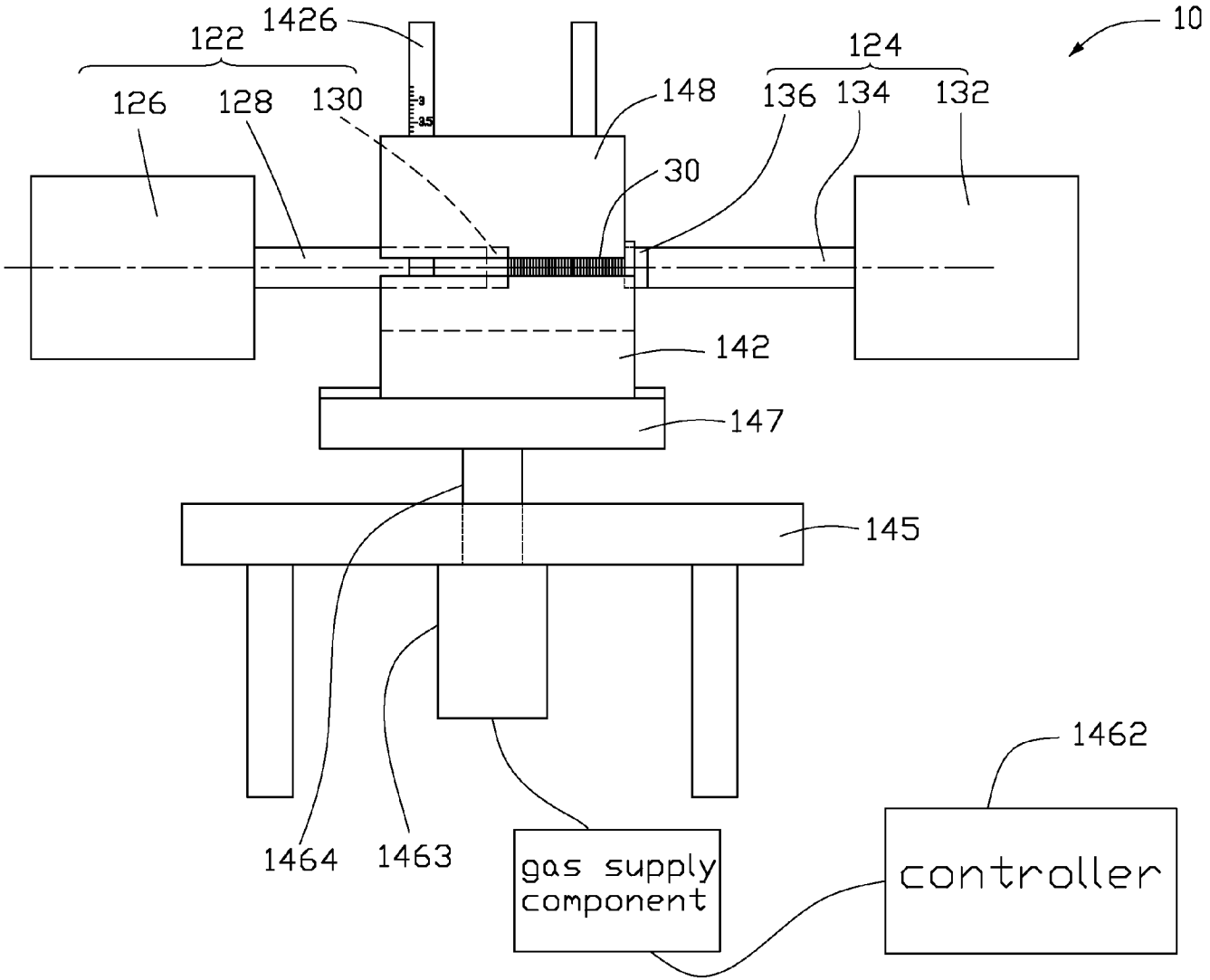
FIG. 7 is a perspective view of the rolling machine of FIG. 1, in use.
Figure 8:
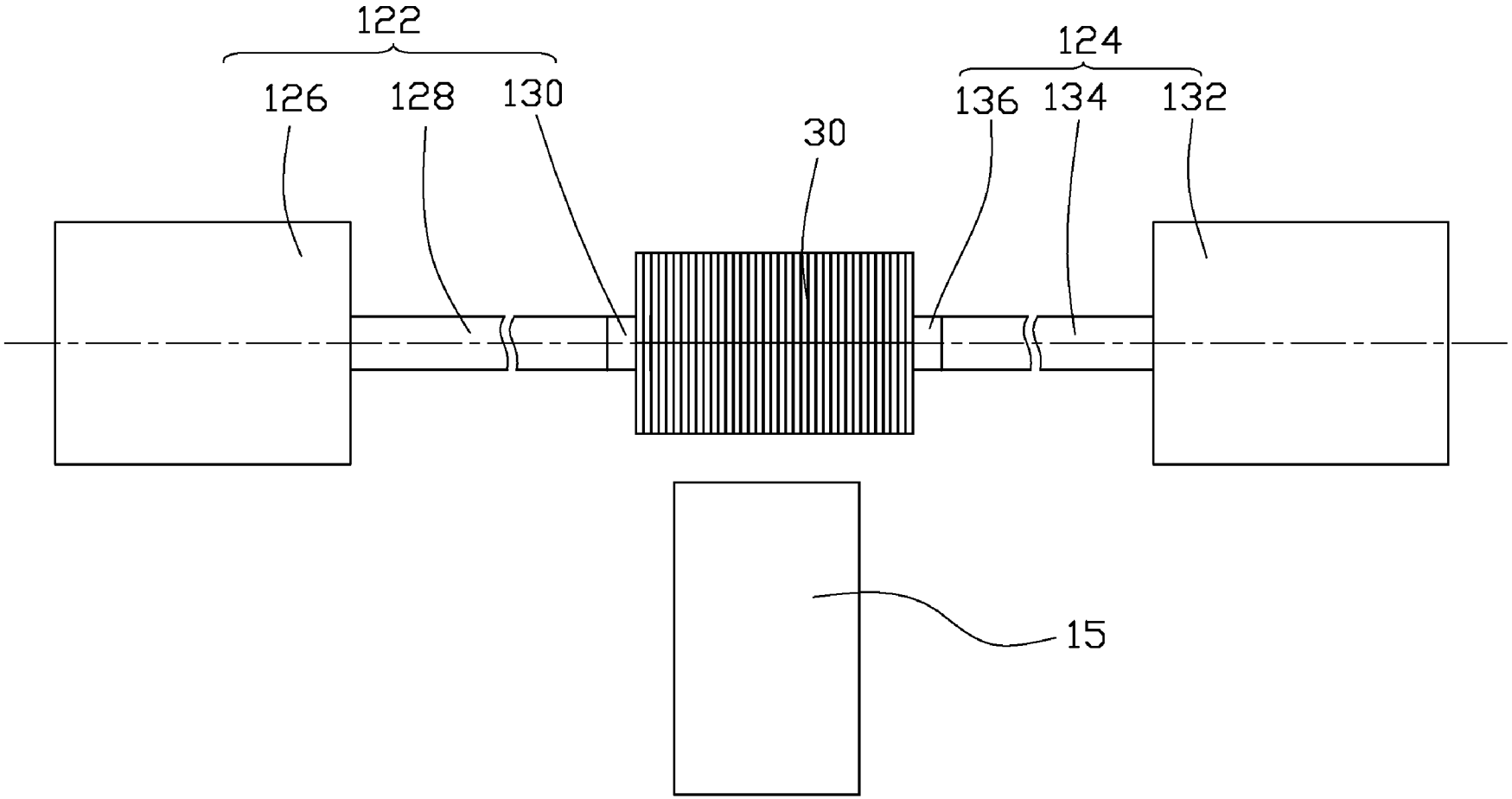
FIG. 8 is a perspective view showing a plurality of workpieces being grinded by a grinding wheel.

Referring to FIGS. 6 to 8, in use, the second clipping component 148 is lifted up. The workpieces 30 are positioned in the first and second recesses 1423, 1483 and clipped between the first and second clipping components 142, 148.

The gas supply component 1466 is controlled by the controller 1462 to supply the amount of gas to drive the piston 1465 and the piston rod 1464. The second supporting unit 147 and the first clipping component 142 are pushed by the piston rod 1464 so that the central axes of the first and second rotating rods 128, 134 and the centers of the workpieces 30 are substantially collinear. The first and second rotating rods 128, 134 are driven to move toward each other along the central axes thereof. The second rotating rod 134 passes through the opening 1428 of the stopping board 1425. The first and second contacting components 130, 136 contact and clip the workpieces 30. The second clipping component 148 is then separated from the first clipping component 142. The controller 1462 controls the driving member 1461 to move the second supporting unit 147 and the first clipping component 142 away from the workpieces 30. Finally, a grinding wheel 15 is used to grind the workpieces 30 into circular shapes.

In one embodiment, the workpieces 30 may be rectangular shaped. A perpendicular distance L between the center of each workpiece 30 and the bottom of the first recess 1423 can be attained by reading the scales of one or more of the measure rods 1426. A perpendicular distance H between the bottom of the first recess 1423 and the central axes of the first and second rotating rods 128, 134 is predetermined. A distance between the central axes of the first and second rotating rods 128, 134 and the central axes of the workpieces 30 can be calculated by the formula: H–L. The gas supply component 1466 is controlled by the controller 1462 to supply the amount of gas to drive the piston 1465 and the piston rod 1464 to move a distance H–L. As a result, the second supporting unit 147 and the first clipping component 142 are pushed by the piston rod 1464 so that the central axes of the first and second rotating rods 128, 134 and the center of the workpieces 30 are substantially collinear.

The auxiliary positioning assembly 14 can align the central axes of the first and second rotating rods 128, 134 with the centers of the workpieces 30, thereby improving grinding accuracy.

It is believed that the present embodiments and their advantages will be understood from the foregoing description, and it will be apparent that various changes may be made thereto without departing from the spirit and scope of the embodiments or sacrificing all of its material advantages, the examples here before described merely being preferred or exemplary embodiments.

What is claimed is:

1. A rolling machine, comprising:

a first clipping component having a first surface and a second surface opposite to the first surface;

a second clipping component having a third surface and a fourth surface opposite to the third surface, the third surface configured to contact the first surface;

a lifting component connected to the first clipping component and configured to drive the first clipping component to move back and forth; and a holding assembly having a first holder and a second holder, the holders configured to be symmetrically positioned on both sides of the first clipping component.

2. The rolling machine of claim 1, wherein a first recess is defined in the first surface; a second recess is defined in the third surface and opposite to the first recess.

3. The rolling machine of claim 2, wherein the first and second recesses are V-shaped.

4. The rolling machine of claim 2, wherein a stopping board is positioned at an end of the first recess; an opening is defined in the stopping board.

5. The rolling machine of claim 1, wherein a plurality of measure rods extends from the first surface; a plurality of through holes is defined in the second clipping component and configured to receive the plurality of measure rods.

6. The rolling machine of claim 1, wherein the lifting component comprises a first supporting unit, a driving unit, and a second supporting unit; the second supporting unit is connected to the first clipping component; the driving unit is configured to drive the second supporting unit and the first clipping component to move with respect to the first supporting unit.

7. The rolling machine of claim 6, wherein a plurality of first positioning units is formed on the second surface of the first clipping component; the second supporting unit has a fifth surface configured to contact the first supporting unit and a sixth surface opposite to the fifth surface and contacting the second surface; a plurality of second positioning units is formed on the sixth surface and engages with the plurality of first positioning units.

8. The rolling machine of claim 7, wherein the plurality of first positioning units is strip-shaped recesses; the plurality of second positioning units is strip-shaped bars received in the plurality of strip-shaped recesses.

9. The rolling machine of claim 7, wherein the plurality of first positioning units is strip-shaped bars; the plurality of second positioning units is strip-shaped recesses receives the plurality of strip-shaped bars.

10. The rolling machine of claim 6, wherein the driving unit comprises a driving member, a controller, and a gas supply component connected to the driving member and configured to supply gas to drive the driving member; the controller is coupled to the gas supply component and configured to control the amount of gas supplied to the driving member to drive the second supporting unit and the first clipping component to move with respect to the first supporting unit.

11. The rolling machine of claim 10, wherein the driving member comprises a cylinder, a piston positioned in the cylinder, and a piston rod; the cylinder is connected to the first supporting unit; the piston rod passes through the first supporting unit and is connected between the piston and the second supporting unit.

12. The rolling machine of claim 1, wherein each of the first and second holders comprises a driver, a rotating rod, and a contacting component; the driver is connected to an end of the rotating rod and configured to drive the rotating rod to rotate; the contacting component is connected to another end of the rotating rod.

13. A clipping assembly for a rolling machine, comprising:

a first clipping component having a first surface and a second surface opposite to the first surface, and defining a first recess in the first surface, the first clipping component comprising a plurality of measure rods positioned on the first surface, at least one of the plurality of measure rods having scales printed thereon; and a second clipping component having a third surface configured to contact the first surface and a fourth surface opposite to the third surface, and defining a second recess in the third surface opposite to the first recess, the second clipping component defining a plurality of through holes configured to receive the plurality of measure rods.

14. The clipping assembly of claim 13, wherein a stopping board is positioned at an end of the first recess; an opening is defined in the stopping board.

15. An auxiliary positioning assembly for a rolling machine comprising:

a first clipping component having a first surface and a second surface opposite to the first surface, and defining a first recess in the first surface, the first clipping component comprising a plurality of measure rods positioned on the first surface, at least one of the plurality of measure rods having scales printed thereon;

a second clipping component having a third surface configured to contact the first surface and a fourth surface opposite to the third surface, and defining a second recess in the third surface opposite to the first recess, the second clipping component defining a plurality of through holes configured to receive the plurality of measure rods; and a lifting component connected to the first clipping component and configured to drive the first clipping component to move back and forth.

16. The auxiliary positioning assembly of claim 15, wherein a stopping board is positioned at an end of the first recess; an opening is defined in the stopping board.

17. The auxiliary positioning assembly of claim 15, wherein the lifting component comprises a first supporting unit, a driving unit, and a second supporting unit; the second supporting unit is connected to the first clipping component; the driving unit is configured to drive the second supporting unit and the first clipping component to move with respect to the first supporting unit.

18. The auxiliary positioning assembly of claim 17, wherein the driving unit comprises a driving member, a controller and a gas supply component; the gas supply component is connected to the driving member and configured to supply gas to drive the driving member; the controller is coupled to the gas supply component, and configured to control gas supply so as to control the driving member to drive the second supporting unit and the first clipping component to move with respect to the first supporting unit.

19. The rolling machine of claim 12, wherein the first and second holders are symmetrically positioned on both sides of the first clipping component.

20. The rolling machine of claim 5, wherein at least one of the plurality of measure rods has scales printed thereon.

* * * * *